US006276670B1

(12) United States Patent
Jacobs

(10) Patent No.: US 6,276,670 B1
(45) Date of Patent: Aug. 21, 2001

(54) COMBINED MIXER-AERATOR

(75) Inventor: David Jacobs, Limal (BE)

(73) Assignee: Aquasystems International N.V., Halle (BE)

( * ) Notice: Subject to any disclaimer, the term of this patent is extended or adjusted under 35 U.S.C. 154(b) by 0 days.

(21) Appl. No.: 09/492,657

(22) Filed: Jan. 27, 2000

(30) Foreign Application Priority Data

Oct. 4, 1999 (BE) ..... 09900658

(51) Int. Cl.[7] ..... B01F 3/04

(52) U.S. Cl. ..... 261/91; 261/120; 210/219; 210/242.2

(58) Field of Search ..... 261/91, 120; 210/219, 210/221.2, 242.2

(56) References Cited

U.S. PATENT DOCUMENTS

| | | | | |
|---|---|---|---|---|
| 2,072,944 | * | 3/1937 | Durdin, III | 261/91 |
| 2,174,147 | * | 9/1939 | Unger, Jr. | 261/91 |
| 2,346,366 | * | 4/1944 | Durdin, III | 261/91 |
| 3,416,729 | * | 12/1968 | Ravitts et al. | 261/120 |
| 3,911,065 | * | 10/1975 | Martin et al. | 261/120 |
| 3,975,469 | * | 8/1976 | Fuchs | 261/91 |
| 4,468,358 | | 8/1984 | Haegeman . | |
| 4,540,528 | | 9/1985 | Haegeman . | |
| 5,021,154 | * | 6/1991 | Haegeman | 261/91 |
| 5,707,562 | * | 1/1998 | Karliner | 261/120 |
| 5,744,072 | * | 4/1998 | Karliner | 210/242.2 |

FOREIGN PATENT DOCUMENTS

| | | |
|---|---|---|
| 0 366 644 | 5/1990 | (EP) . |
| WO 99/01386 | 1/1999 | (WO) . |

* cited by examiner

*Primary Examiner*—C. Scott Bushey
(74) *Attorney, Agent, or Firm*—Merchant & Gould P.C.

(57) ABSTRACT

The invention describes an apparatus which can be used both for aeration of water and mixing of water. The apparatus comprises a power source which can drive a helical propelling device, whereby the propelling device can operate in both directions of rotation. The propelling device is located completely below the surface of the water. Further, the apparatus is fitted with an additional circulation element which is positioned above the propelling device and at least partly below the surface of the water. The apparatus can also be fitted with further conventional elements such as a pump housing, a deflector and so on. The propelling device is affixed to the shaft below the surface of the water and at a distance from the surface of the water which is such that, as a function of the speed of rotation and the dimensioning of the propelling device, the distance between the top side of the propelling device and the surface of the water is sufficiently great to prevent air being sucked in when the propelling device is operating in the mixing mode but does allow the water which is pumped up to be dispersed across the surface of the water or the air sucked in to be driven into the water if the propelling device is operating in aeration mode.

11 Claims, 2 Drawing Sheets

COMBINED MIXER-AERATOR

FIELD OF THE INVENTION

This invention concerns an apparatus which is used for the aeration and/or mixing of water, in particular waste water.

BACKGROUND OF THE INVENTION

Apparatus for the aeration of water comprising a power source which drives a shaft to which a mixing device is affixed are well known, as can be seen from the Belgian patent 893.687.

European patent 0.366.644 describes this type of aerator in a form which can also be used as a mixer, whereby the power source is secured to a structure comprising two floats positioned one on top of the other and whereby the lower float can be immersed by the introduction of ballast.

The power source drives a helical propelling device which can operate in both directions of rotation. This apparatus can be used as an aerator when the top float is positioned above the surface of the water (The unit is then actually floating on the bottom float). If the apparatus floats on the top float and the direction of rotation is reversed, this apparatus can be used as a mixer.

Because of the twin floats and the associated manufacturing and operation costs there is a pressing need for a simpler apparatus which can be used both as a mixer and as an aerator.

A detailed investigation has been carried out to find an as simple apparatus design as possible, starting from a conventional mixer and from the apparatus described in EP 0.366.644, in which all the components have undergone an in-depth analysis and in which all possible parameters of each component have been studied during usage.

SUMMARY OF THE INVENTION

Surprisingly it was found that such an apparatus can be simply constructed if the following elements are employed correctly:

1. it is necessary for the power source to drive a shaft, to which a propelling device is secured, which can operate in both directions, in order to mix efficiently on the one hand, and to aerate efficiently on the other;
2. the propelling device must be helical;
3. the propelling device must be located completely below the surface of the water;
4. on the shaft, above the propelling device, at least partly below the surface of the water, an additional circulation element must be secured, which creates a water flow in the opposite direction to the movement generated by the propelling device.

In the text which follows "mixing" shall mean that the water is displaced from an area in a shallower position to an area in a deeper position; "aeration" shall mean that water is dispersed across the surface of the water or that a water-air mixture is displaced from the surface of the water to an area in a deeper position.

In a first aspect the invention therefore comprises an apparatus which can be used both as a mixer and as an aerator and which comprises a power source which drives a shaft upon which a helical propelling device is affixed, whereby the power source can drive the propelling device in both directions of rotation, characterized in that the propelling device is affixed to the shaft below the surface of the water and that above the propelling device, but at least partly below the surface of the water, an additional circulation element is affixed to the shaft which makes the water move in the opposite direction to the movement generated by the propelling device.

In a second aspect the invention comprises a method of operating the apparatus.

The propelling device should preferably be affixed to the shaft below the surface of the water at a distance from the surface of the water which is such that, as a function of the speed of rotation and the dimensioning of the propelling device, the distance between the top edge of the propelling device and the surface of the water is sufficiently great to prevent air being sucked in if the propelling device is operating in mixing mode, but does allow the water which is pumped up to be dispersed across the surface of the water or the air sucked in to be driven into the water if the propelling device is operating in aeration mode.

The correct position of the propelling device may be determined by the man skilled in the art whereby he may also often take into account, for example, the composition of the waste water, the depth of the basins, and also the other components with which the apparatus is fitted, some examples of which are described below.

The correct position may also be determined as a function of the use to which the apparatus is put. If, for example, an apparatus is desired which will preferably be used as a mixer, the indication can be to position the propelling device as deeply as possible in the water, although still allowing aeration to take place (in the aeration phase). On the other hand, when the apparatus is used predominantly as an aerator the propelling device can be positioned as closely as possible to the surface of the water while still allowing sufficient mixing to take place (in mixing mode).

The additional circulation element can be in the form of a plate, possibly corrugated or otherwise folded, but must impart a movement to the water which is in the opposite direction to the movement brought about by the propelling device. By preference the circulation element is in the shape of a blade.

The circulation element also allows the vortex above the propelling device to be broken up; this vortex occurs if the propelling device operates in the mixing direction thus propelling water downwards. Because the circulation element can impart a slight upwards movement and then a toroidal movement to the water not only the vortex is broken up but foam and other floating elements—which are usually present on the surface of the water—are sucked in and propelled downwards with the water circulation.

By preference the circulation element will be positioned below the surface of the water, possibly right against the surface of the water, which also prevents air being sucked into the water during the mixing movement.

In order to improve the flow of the water it can be advantageous to fit the apparatus with a deflector which will preferably be conical in shape. This deflector can be affixed to the apparatus above the circulation element and then preferably near or just above the surface of the water. The deflector can also be positioned below the surface of the water, for example between the propelling device and the circulation element.

The deflector can be affixed to the shaft if it also has to rotate, but can also be secured in a fixed position to a structural element.

In accordance with a beneficial design form, the propelling device is at least in part surrounded by a pump housing, which is positioned fully below the surface of the water. The pump housing will preferably be cylindrical in shape and have a circular section, whereby it can be advantageous if on the top side and/or the underside an outwardly fanning conical inlet or outlet is positioned.

Although unnecessary, the best effect is obtained when a volute or pump housing surrounds the propelling device over the full height.

Further, the pump housing can be provided with stabilizers, water guides and other known parts, whereby these elements can also play a role in the structure of the apparatus.

The power source can be positioned either above or below the surface of the water. Above the surface of the water the power source can be suspended on a structure or can be carried on floats. If the power source is carried on one or more floats it is useful to avoid that the floats influence the movement of the water caused by the propelling device.

BRIEF DESCRIPTION OF THE DRAWINGS

The invention will now be described in more detail using some non-restrictive embodiment forms with reference to the attached schematic drawings, in which.

DESCRIPTION OF PREFERRED EMBODIMENTS

Figure 1B:
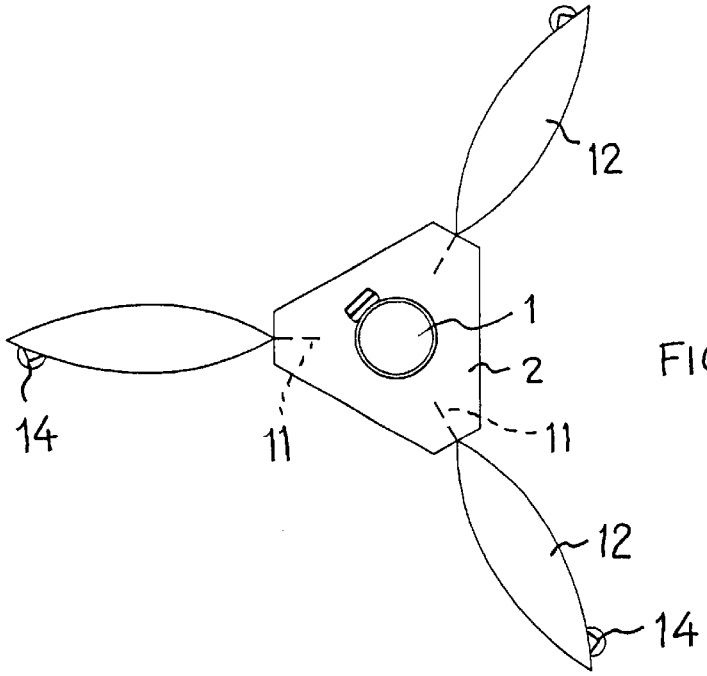
FIG. 1*b* shows a (reduced) top view of the mixer/aerator in accordance with FIG. 1*a;*

With reference to the drawings, FIG. 1 gives a schematic representation of a power source 1, positioned on a support plate 2. The power source 1 rotates a shaft 3 to which a propeller 5 is affixed. The power source 1 can make the propeller 5 work in both directions of rotation. The propeller 5 comprises a double-threaded helix 6 with a wide diameter on the underside 7 which reduces gradually to nothing at the top side 8. The distance between the surface of the water 9 and the top side 8 is set in such a way that with the upward movement of the water a sufficient dispersion of the water takes place above the surface of the water and that in mixing mode when there is a downward movement no air is drawn into the water.

The propeller 5 has a right-hand helix 6 and imparts to the water, as a function of the direction of rotation, a downward or upward movement. Above the propeller 5 on the shaft 3 an additional helix 18 (circulation element) is positioned. This helix 18 has only one partial thread. The movement brought about by the helix or blade 18 is in opposition to the flow imparted by helixes 6.

Figure 1A:
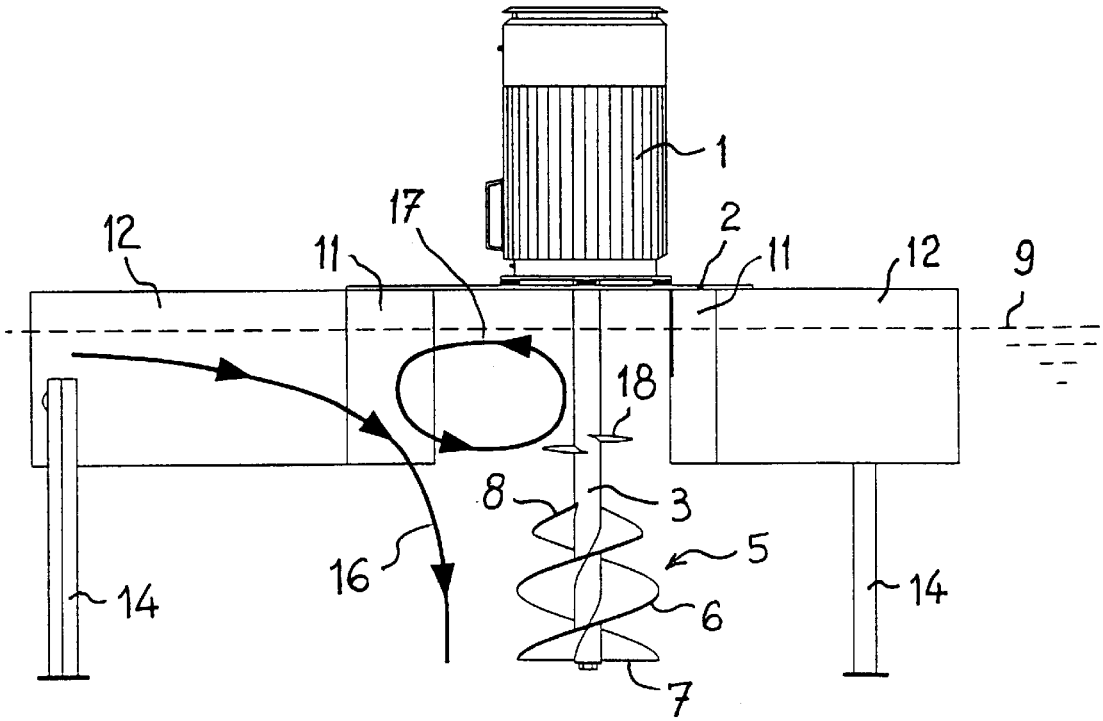
FIG. 1*a* shows a cross-section of a basic design form of a mixer/aerator in accordance with the invention.

FIG. 1*a* shows the mixing mode and illustrates the downward movement of the water with arrows 16. The arrows 17 show the local movement brought about by the additional helix 18. The arrows 17 also illustrate the breaking up of the vortex which normally will occur around shaft 3 just below the surface of the water.

The presence of helix 18 also prevents air being sucked into the water and at the same time helps the impurities floating on the surface of the water to be displaced downwards.

The support plate 2 for the power source 1 is connected by connecting elements 11 with three floats 12, which are positioned at an angle of 120° (opposite the mid-point) to each other and keep the apparatus afloat.

The connection between the support plate 2 and the floats 12 on the one hand and the shape of the floats on this other, is designed such that the flow of the water caused by the propeller 5 and by the helix 18 is not significantly affected.

The apparatus further comprises three legs 14 by means of which the whole, when it is lifted out of the water, can be set down without resting on the propeller or the floats.

FIG. 1*b* is a reduced representation of a top view of the apparatus, whereby the shape of the floats 12 can be seen.

Figure 2:
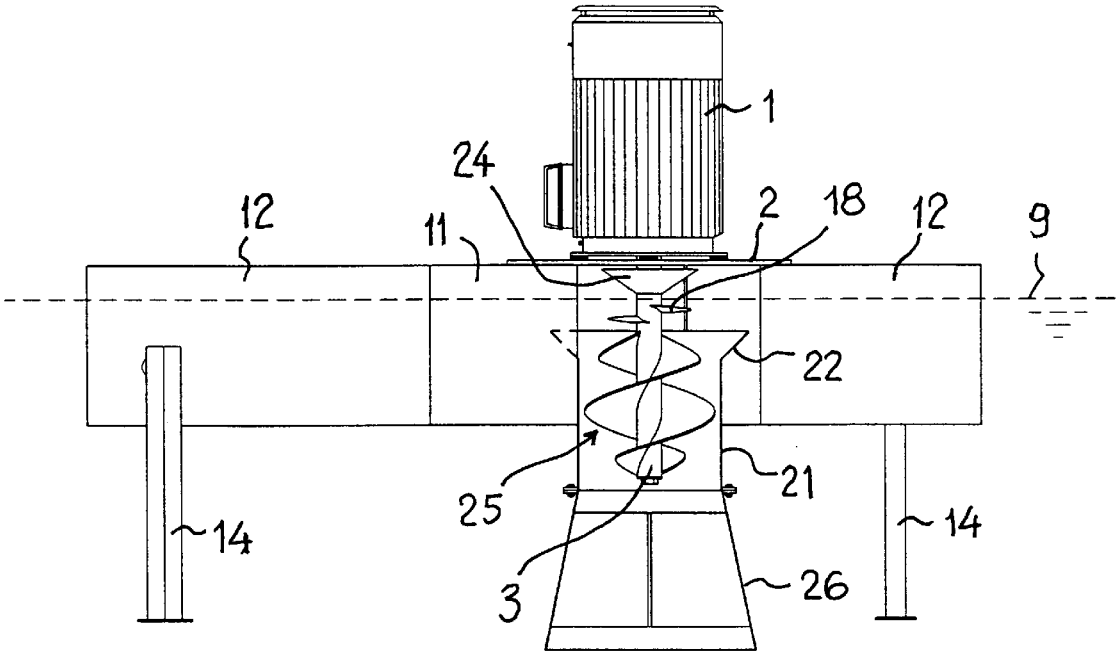
FIG. 2 shows a cross-section of a variant of the mixer/aerator described in FIG. 1.

FIG. 2 shows an apparatus similar to the apparatus described in FIG. 1 whereby the same elements with the same reference numbers are represented. It is possible to recognize the power source 1 with the support plate 2, the shaft 3 with the propeller 25 and circulation element 18. The propeller 25 has a slightly different shape compared with the propeller described in FIG. 1 and extends to the underside with a zero diameter. On the shaft 3 of the apparatus above the circulation element 18 and above the surface of the water 9 a conical deflector 24 is positioned, whereby a deflection of the water movement caused by circulation element 18 is obtained thus influencing the operation of the apparatus in a beneficial manner.

It is clear that the deflector does not necessarily have to be affixed to the shaft so that it rotates with it, but may be secured to the support plate 2 of the power source 1 thereby constituting a fixed deflector.

Around and to the full height of the propeller 25 a cylindrical pump housing 21 is positioned. The pump housing 21 is on the top side extended by an outwardly directed conical section 22, through which the water circulation and in particular the upward movement of the water during the aeration mode, is improved. The pump housing 21 is also extended downwards with an outwardly extending conical extension piece 26, which also has a beneficial effect on the water circulation.

The pump housing 21 has a fixed connection with the connecting elements 11 and thus with the floats 12 and the support plate 2, so that the apparatus forms a solid whole.

It is clear that the invention is not limited to the embodiment forms described above, but includes any variant which comprise the necessary elements given in the attached claim 1.

Thus the helix of the propelling device and the circulation element can have all possible forms and can be single or multiple.

The run-out of the helixes of the propelling device and also of the circulation element can have an adapted form in order to promote the circulation of the water.

The circulation element does not necessarily have to be positioned completely below the surface of the water but can also be positioned partly above the surface of the water.

The power source can also be positioned below the surface of the water.

The apparatus can further be fitted with other supplementary elements, as for example a particular supply of air can be provided from above the surface of the water to the propeller, whereby air bubbles can be introduced in mixing mode.

An operator may select the various parts of the apparatus as a function of the usage of the apparatus.

What is claimed is:

1. An apparatus which can be used both as a water mixer and water aerator and which comprises a power source which drives a shaft to which a helical propelling device is affixed at a position which in use is below the surface of the water, said apparatus further comprising an additional circulation element which is affixed on said shaft at a position above said helical propelling device and which in use is at least partly below the surface of the water, whereby said power source can drive said helical propelling device in both directions of rotation and whereby said circulation element imparts a movement to the water which is opposite to the movement provided by said helical propelling device.

2. An apparatus in accordance with claim 1, in which said circulation element is helical.

3. An apparatus in accordance with claim 1, which further comprises a conical deflector which is affixed above said circulation element.

4. An apparatus in accordance with claim 1, in which said helical propelling device is at least partly surrounded by a pump housing which in use is located completely below the surface of the water.

5. An apparatus in accordance with claim 4, in which said pump housing surrounds said helical propelling device to its full height.

6. An apparatus in accordance with claim 5, in which a top end of said pump housing has a conical extension.

7. An apparatus in accordance with claim 5, in which a bottom end of said pump housing has a conical extension.

8. An apparatus in accordance with claim 4, in which said power source is positioned on a support plate which is connected to said pump housing by connectors.

9. An apparatus in accordance with claim 4, in which said power source is positioned on a support plate which is connected to floats by connectors which have a fixed connection with said pump housing.

10. An apparatus in accordance with claim 1, which further comprises legs so that said apparatus can be set down when it is lifted out of the water.

11. An apparatus in accordance with claim 1, in which, in use, a distance between the top side of said helical propelling device and the surface of the water is sufficiently great (i) if said helical propelling device is operating in mixing mode to prevent air being sucked in and (ii) if said helical propelling device is operating in aeration mode to allow the water which is pumped up to be dispersed across the surface of the water or the air sucked in to be driven into the water, whereby said distance is determined as a function of the speed of rotation and the dimension of said helical propelling device.

* * * * *